US010619638B2

(12) United States Patent
Peroni et al.

(10) Patent No.: US 10,619,638 B2
(45) Date of Patent: Apr. 14, 2020

(54) MECHANICAL AUTOMOTIVE VACUUM PUMP WITH CANTILEVERED ROTOR

(71) Applicant: PIERBURG PUMP TECHNOLOGY GMBH, Neuss (DE)

(72) Inventors: Giorgio Peroni, Pisa (IT); Raffaele Squarcini, Leghorn (IT); Michael Rombach, Neuss (DE); Giorgio Mamberti, Collesalvetti (IT)

(73) Assignee: PIERBURG PUMP TECHNOLOGY GMBH, Neuss (DE)

( * ) Notice: Subject to any disclaimer, the term of this patent is extended or adjusted under 35 U.S.C. 154(b) by 199 days.

(21) Appl. No.: 15/738,124

(22) PCT Filed: Jun. 24, 2015

(86) PCT No.: PCT/EP2015/064280

§ 371 (c)(1),
(2) Date: Dec. 20, 2017

(87) PCT Pub. No.: WO2016/206737

PCT Pub. Date: Dec. 29, 2016

(65) Prior Publication Data

US 2018/0180048 A1 Jun. 28, 2018

(51) Int. Cl.

| | |
|---|---|
| ***F04C 29/00*** | (2006.01) |
| ***F04C 18/344*** | (2006.01) |
| ***F04C 2/06*** | (2006.01) |
| ***F04C 25/02*** | (2006.01) |

(Continued)

(52) U.S. Cl.
CPC ..... *F04C 29/0042* (2013.01); *F04C 18/3441* (2013.01); *F04C 25/02* (2013.01);
(Continued)

(58) Field of Classification Search
CPC ..... F04C 29/0042; F04C 18/344; F04C 2220/10; F04C 25/02; F04C 29/00;
(Continued)

(56) References Cited

U.S. PATENT DOCUMENTS 2,410,596 A * 11/1946 Bradford ..... F01C 21/0809 418/145
3,433,166 A * 3/1969 Birkemeier ..... F01C 21/008 418/108

(Continued)

FOREIGN PATENT DOCUMENTS

CN 203035555 U 7/2013
CN 103671092 A 3/2014

(Continued)

*Primary Examiner* — Deming Wan
(74) *Attorney, Agent, or Firm* — Norman B. Thot

(57) ABSTRACT

A vacuum pump includes a pump rotor comprising a rotor body, a housing arrangement, a slidable pump vane, and a backing support cone structure. The rotor body comprises a vane slit, a conical ring, a coupling-sided end portion, and a vane-sided end portion. The housing arrangement comprises a static conical ring corresponding to the conical ring. The slidable pump vane is supported in the vane slit. The backing support cone structure is arranged at a front end of the vane-sided end portion and is defined by the conical ring of the rotor body and the static conical ring of the housing arrangement. A coupling structure and a single radial bearing are each arranged at the coupling-sided end portion of the rotor body and a radial bearing is not arranged at the vane-sided end portion of the rotor body so that the rotor body is radially supported cantilevered.

16 Claims, 4 Drawing Sheets

(51) Int. Cl.

| | |
|---|---|
| ***F04C 18/06*** | (2006.01) |
| ***F01C 21/08*** | (2006.01) |
| *F04C 29/02* | (2006.01) |

(52) U.S. Cl.
CPC ..... *F04C 29/0085* (2013.01); *F04C 29/02* (2013.01); *F04C 2220/10* (2013.01); *F04C 2240/20* (2013.01); *F04C 2240/51* (2013.01)

(58) Field of Classification Search
CPC ..... F04C 2240/60; F04C 18/06; F04C 2/06; F01C 21/0809
See application file for complete search history.

(56) References Cited

U.S. PATENT DOCUMENTS

| | | | | |
|---|---|---|---|---|
| 4,311,440 | A | 1/1982 | Eberhardt | |
| 4,604,041 | A * | 8/1986 | Hertell | F04C 18/3441 418/268 |
| 4,925,378 | A | 5/1990 | Ushiku et al. | |
| 5,449,276 | A | 9/1995 | Maruyama et al. | |
| 2010/0239440 | A1 * | 9/2010 | Heaps | F04C 18/3442 417/364 |
| 2013/0052057 | A1 | 2/2013 | Hüser et al. | |

FOREIGN PATENT DOCUMENTS

| | | | |
|---|---|---|---|
| DE | 10 2004 003 567 | A1 | 9/2004 |
| DE | 10 2008 054 240 | A1 | 7/2009 |
| JP | 8-312554 | A | 11/1996 |
| WO | WO 2010/031504 | A3 | 3/2010 |

* cited by examiner

MECHANICAL AUTOMOTIVE VACUUM PUMP WITH CANTILEVERED ROTOR

CROSS REFERENCE TO PRIOR APPLICATIONS

This application is a U.S. National Phase application under 35 U.S.C. § 371 of International Application No. PCT/EP2015/064280, filed on Jun. 24, 2015. The International Application was published in English on Dec. 29, 2016 as WO 2016/206737 A1 under PCT Article 21(2).

FIELD

The present invention relates to a mechanical automotive vacuum pump which is mechanically driven by an internal combustion engine.

BACKGROUND

DE 10 2008 054 240 A1 describes a rotor of a mechanical automotive vacuum pump. The rotor is defined by a rotor body which is provided with a vane slit for supporting a slidable pump vane. The rotor body is provided with a coupling structure at a coupling-sided end portion of the rotor body and is provided with a cylindrical radial bearing surface at the same coupling-sided end portion. The rotor body is provided with a second radial bearing at the vane-sided end portion of the rotor body. The second radial bearing is provided with a cylindrical bearing portion for defining a second radial friction bearing at the vane-sided end of the rotor body. Production costs are considerable since two separate radial bearings are provided.

SUMMARY

An aspect of the present invention is to provide a cost-effective mechanical automotive vacuum pump.

In an embodiment, the present invention provides a mechanical automotive vacuum pump which includes a pump rotor, a housing arrangement, a slidable pump vane, and a backing support cone structure. The pump rotor comprises a rotor body and a rotational axis. The rotor body comprises a vane slit, a conical ring, a coupling-sided end portion, and a vane-sided end portion. The housing arrangement comprises a static conical ring which corresponds to the conical ring of the rotor body. The housing arrangement is configured to enclose a pumping chamber and to rotatably support the pump rotor. The slidable pump vane is supported in the vane slit. The slidable pump vane is configured to separate the pumping chamber into a plurality of rotating pumping compartments. The backing support cone structure is arranged at a front end of the vane-sided end portion. The backing support cone structure is defined by the conical ring of the rotor body and the static conical ring of the housing arrangement. The backing support cone structure comprises a cone angle of between 5° and 85° with respect to the rotational axis of the pump rotor. A coupling structure and a single radial bearing are each arranged at the coupling-sided end portion of the rotor body and a radial bearing is not arranged at the vane-sided end portion of the rotor body so that the rotor body is radially supported cantilevered.

BRIEF DESCRIPTION OF THE DRAWINGS

The present invention is described in greater detail below on the basis of embodiments and of the drawings in which.

DETAILED DESCRIPTION

Figure 1:
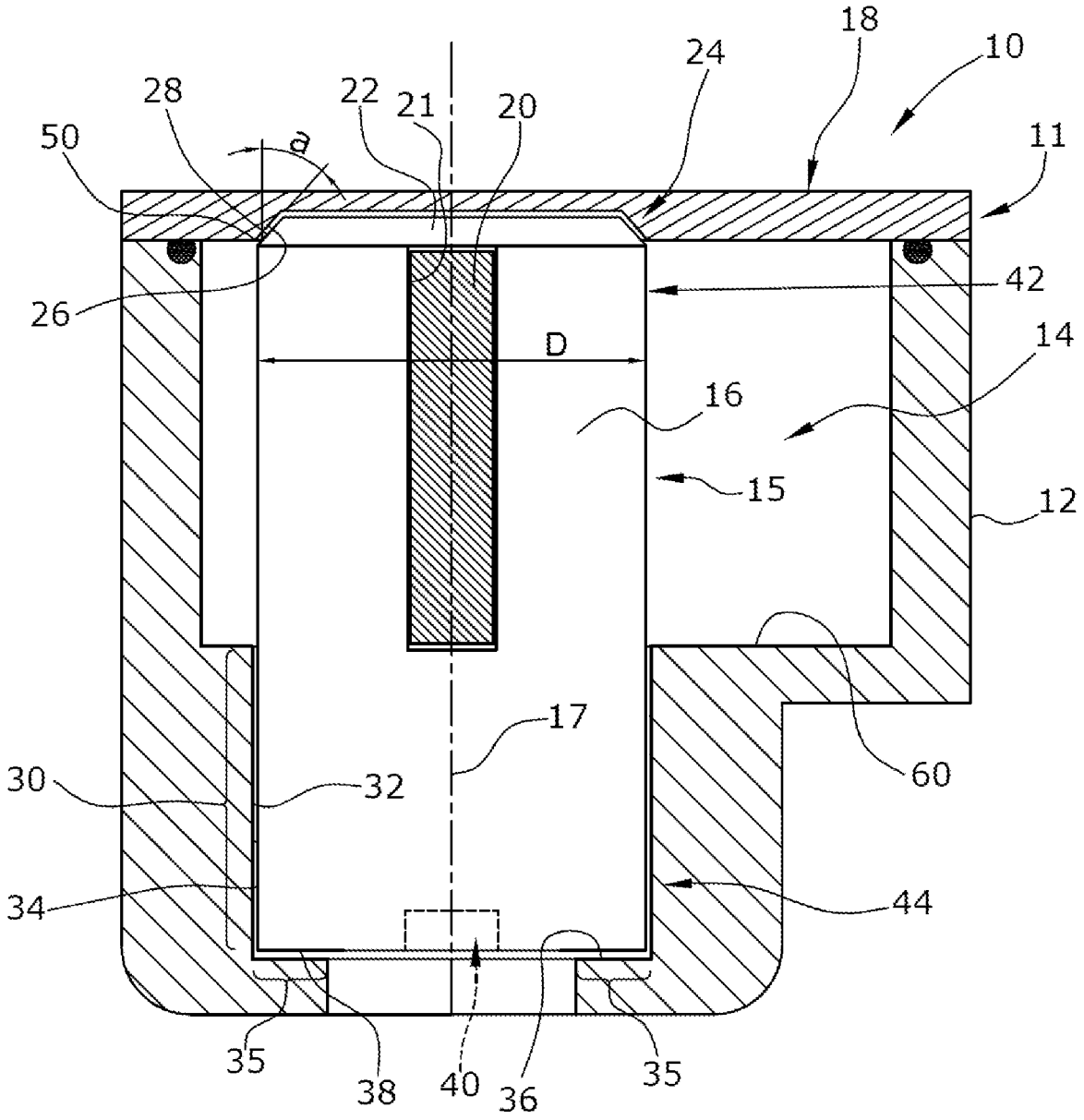
FIG. 1 shows a longitudinal section of a first embodiment of a mechanical automotive vacuum pump with a maximum diameter of the backing support cone structure.

According to the present invention, the mechanical automotive vacuum pump is provided with a housing arrangement which encloses a pumping chamber and which rotatably supports a pump rotor with a rotor body. The housing arrangement is completely static. The rotor body is provided with at least one vane slit wherein a slidable pump vane is supported. The pump vane separates the pumping chamber, which is defined by the housing arrangement, into several pumping compartments. The pumping compartments also rotate when the pump rotor rotates.

The rotor body is provided with a coupling structure at a coupling-sided end portion. A single radial bearing is also provided at the coupling-sided end portion of the rotor body. No second radial bearing is provided; no other radial bearing is in particular provided at the other axial end portion of the rotor body which is the vane-sided end portion. The rotor body is therefore supported cantilevered. The single radial bearing at the coupling-sided end portion can, for example, be provided as a frictional bearing.

A backing support cone structure is provided at the front end of the vane-sided end portion of the rotor body. The backing support cone structure is defined by an outside conical ring at the rotor body and a corresponding static inside conical ring at the pump housing. The cone structure has a cone angle of between 5° and 85° with respect to the rotational axis of the pump rotor, for example, between 30° and 60°. No other radial or axial bearing is provided at the vane-sided axial end of the pump rotor. The positive conus basis is provided at the rotor body, whereas the housing-sided conical ring defines a negative hollow conus.

The backing support cone structure stabilizes the cantilevered axial end portion of the rotor body, in particular at a high rotational speed of the pump rotor. The backing support cone structure does not require a high accuracy of the conical rings defining the support surfaces at the rotor body and the pump housing which together define the backing support cone structure. No sophisticated machining is therefore necessary to provide some kind of backing support for the cantilevered axial end of the rotor body.

In an embodiment of the present invention, an axial and radial play of more than 0.1 mm can, for example, be provided which allows the rotor body to minimally move axially. As a result, the rotor-sided conical ring and the static conical ring of the cone structure are not always in contact, but are in particular in contact if the vane-sided end portion of the rotor body is radially vibrating at high rotational speed. No high-quality lubrication of this section is necessary because the conical rings defining the backing support cone structure are not always in direct contact with each other. If the mechanical automotive vacuum pump is designed as a lubricated pump, some lubrication caused by spilling is always present in this area and is sufficient to lubricate the backing support cone structure.

In an embodiment of the present invention, the rotor body can, for example, be cylindrical with one single diameter in the vane-sided end portion and at the coupling-sided end portion. In other words, the complete rotor body is designed as a single cylinder, beside the backing support cone structure. The rotor body can, for example, be made of a single piece, for example, out of plastic.

In an embodiment of the present invention, the conus basis of the backing support cone structure can, for example, have the same diameter as the rotor body. The conus basis has the maximum possible diameter so that frictional wearout is minimized.

The conus basis at the rotor body alternatively has a diameter which is at least 10% smaller than the diameter of the cylindrical section of the rotor body.

In an embodiment of the present invention, the backing support cone structure can, for example, be provided with a hollow cone with a conical ring provided at the rotor body. A central recess is provided within the conical ring. This structure allows a vane slit which to be provided which is axially open at the vane-sided end portion.

In an embodiment of the present invention, the hollow cone can, for example, be provided with an inner cone surface which is supported by a corresponding outer cone surface of the housing arrangement. The inner cone surface is provided at the radial inside of the cone ring in addition to the backing support cone structure at the radial outside of the rotor body's conical ring. As a result, the cantilevered axial end of the rotor body is stabilized by two cone structures. The cone angle of the additional cone structure can be equal or similar to the cone angle of the main backing support cone structure.

Four embodiments of the present invention are described below under reference to the drawings.

The drawings show a mechanical automotive vacuum pump 10 which provides a total pressure of below 100 mbar for supplying, for example, a pneumatic braking force device with the low pressure. The vacuum pump 10 is mechanically driven by an automotive engine, for example, by an internal combustion engine.

The vacuum pump 10 comprises a static housing arrangement 11 which supports and substantially houses a rotatable pump rotor 15. The housing arrangement 11 comprises a pot-shaped housing main body 12 for radially enclosing and rotatably supporting the pump rotor 15 and also comprises a separate housing cover lid 18 for axially closing the vane-sided end of the housing arrangement 11.

The pump rotor 15 comprises a plastic pump rotor body 16 with a substantially cylindrical and stepless outer surface almost over the entire axial length of the rotor body 16. The rotor body 16 is cylindrical and has a diameter D. The rotor body 16 is axially provided with two functional partitions, namely, the vane section 42 with a radial vane slit 21, and a bearing section 44 with a radial bearing 30 which is a frictional radial bearing. The radial bearing 30 is defined by a static housing-sided cylindrical inside bearing surface 32 and by a cylindrical outside bearing surface 34 of the rotor body 16. The vane slit 21 supports a radially shiftable pump vane 20 which is defined by one single vane body which co-rotates with the rotor body 16. The pump vane 20 separates the pumping chamber 14 into two rotating pumping compartments which rotate when the pump rotor 15 rotates.

The vacuum pump 10 and in particular the interior of the vacuum pump 10 is lubricated with oil which is branched off the engine oil supply system.

The rotor body 16 is radially supported by the radial bearing 30, which can be a radial friction bearing, and rotates around a rotational axis 17. The radial bearing 30 is the only radial bearing of the vacuum pump 10.

An axial ring bearing 35 is provided at the bearing-sided front end of the vacuum pump 10. The axial ring bearing 35 comprises a rotor-sided bearing ring surface 38 and a housing-sided axial bearing ring surface 36. The central portion of the housing inside the axial ring bearing 35 is open so that the axial front end of the pump rotor 15 is accessible. The axial bearing is needed only if the vane slit is axially open as in the embodiments shown in FIGS. 3 and 4. In the embodiments shown in FIGS. 1 and 2, the rotor is prevented from moving axially just by the pump vane 20 itself. The axial front end of the rotor body 15 is provided with a coupling structure 40 for engaging a corresponding coupling structure of a pump drive.

The vacuum pump 10 according to the first embodiment shown in FIG. 1 is provided with a full-diameter backing support cone structure 24 at the vane-sided front end of the rotor body 16. The backing support cone structure 24 is defined by an outside conical ring 28 defining a cone 22 at the rotor body 16 and by a corresponding static inside conical ring 26 at the housing arrangement 11. The cone 22 is provided at the rotor body 16. The cone angle a with respect to the rotational rotor axis 17 is, in this embodiment, about 45°. The conus basis 50 of the cone 22 of the backing support cone structure 24 has the same diameter D as the cylindrical outer surface of the rotor body is 16.

Figure 2:
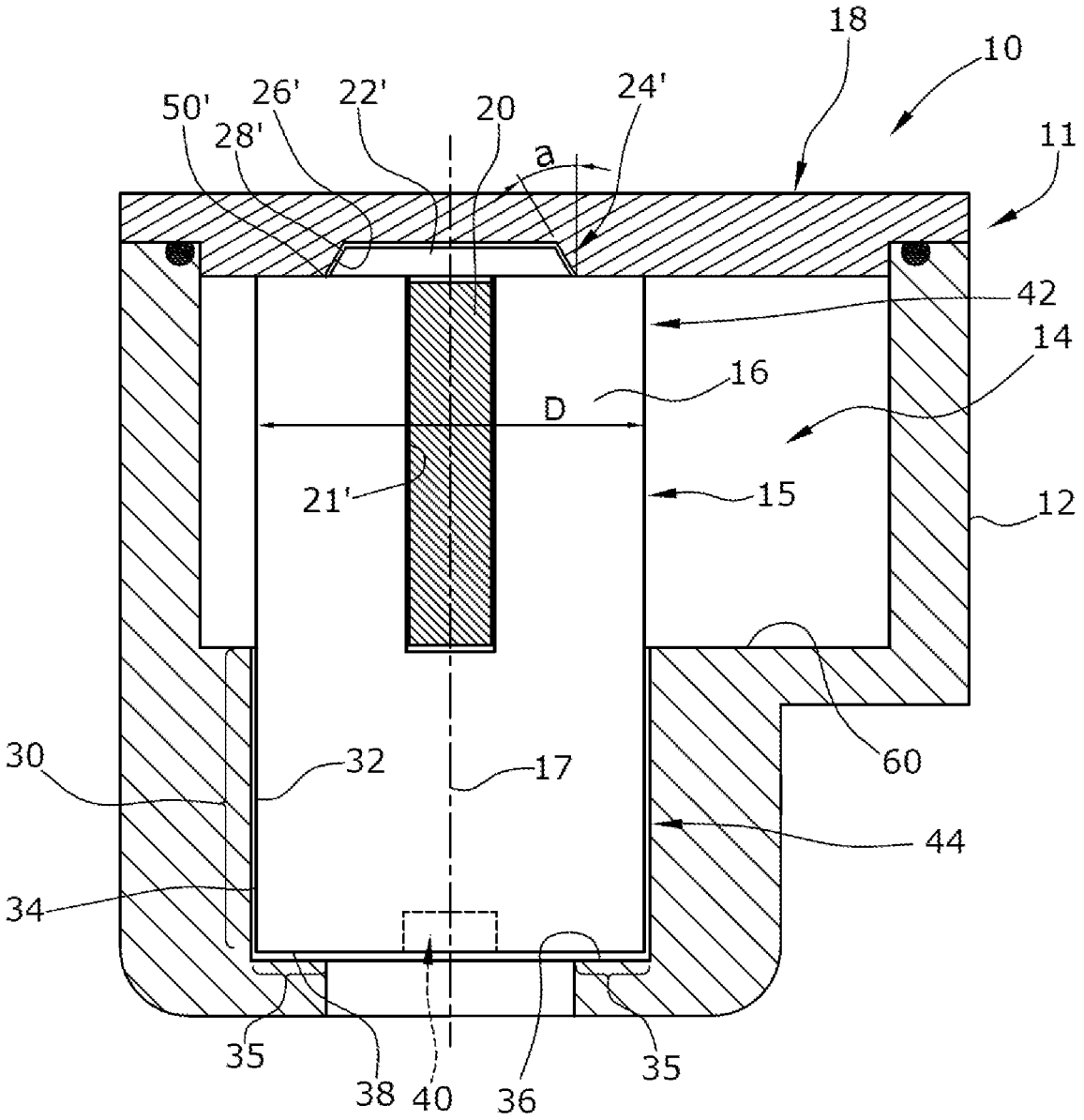
FIG. 2 shows a longitudinal section of a second embodiment of a mechanical automotive vacuum pump with a backing support cone structure with a reduced diameter.

The vacuum pump 10 according to the second embodiment shown in FIG. 2 only differs in the shape and diameter of the cone 22' of the backing support cone structure 24'. The diameter of the conus basis 50' of the backing support cone structure 24' is considerably less than the outer diameter D of the rotor body 16 which is cylindrical. The cone angle a is about 30°.

The vacuum pump 10 of the first and the second embodiment shown in FIGS. 1 and 2 is provided with a vane slit 21; 21' which is axially not open. This construction provides a relatively small fluidic backflow so that a high pneumatic efficiency is realized. The axial ring bearing 35 can be omitted in the first and second embodiment with a closed vane slit 21 because this function can be taken over by the axial vane end sliding at the transversal pumping chamber wall 60 opposite the housing cover lid 18.

Figure 3:
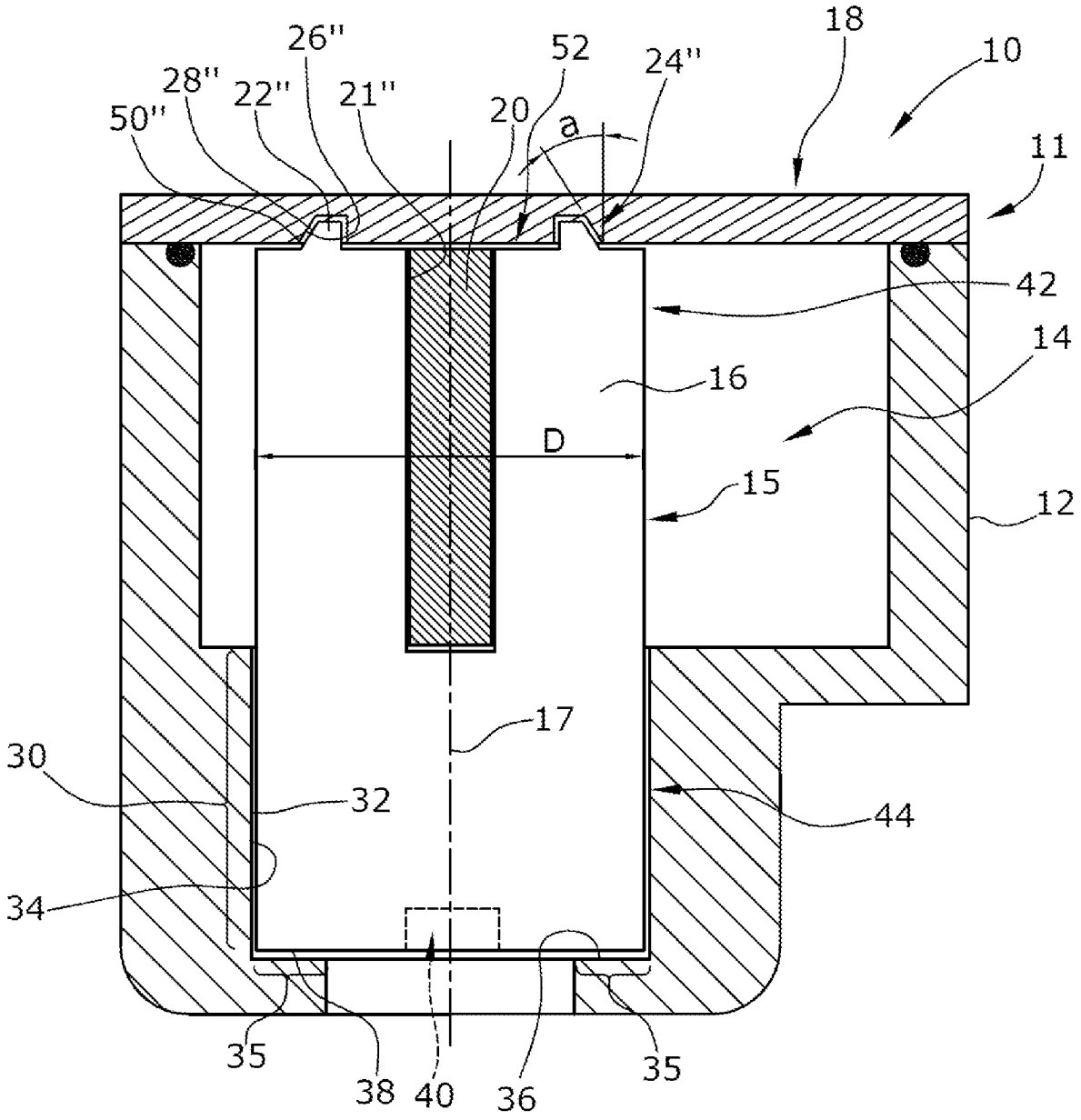
FIG. 3 shows a third embodiment of a mechanical automotive vacuum pump with a ring-like backing support cone structure at the rotor body and with a vane slit which is axially open at the vane-sided end portion of the rotor body.

The vacuum pump 10 according to the third embodiment shown in FIG. 3 is provided with a cone 22" which is hollow which surrounds a central recess 52 at the vane-sided front end of the rotor body 16. The diameter of the conus basis 50" of the backing support cone structure 24" is considerably less than the outer diameter D of the rotor body 16 which is cylindrical. The cone angle a is about 35°. The cone 22" defines an outside conical ring 28" of the rotor body 16, whereas the corresponding ring-like groove at the housing arrangement 11 defines a corresponding static inside conical ring 26". Both rings 26", 28" together define the backing support cone structure 24". The vane slit 21" is axially open so that the production of the rotor body 16 is relatively simple, in particular if the rotor body 16 is made out of metal.

Figure 4:
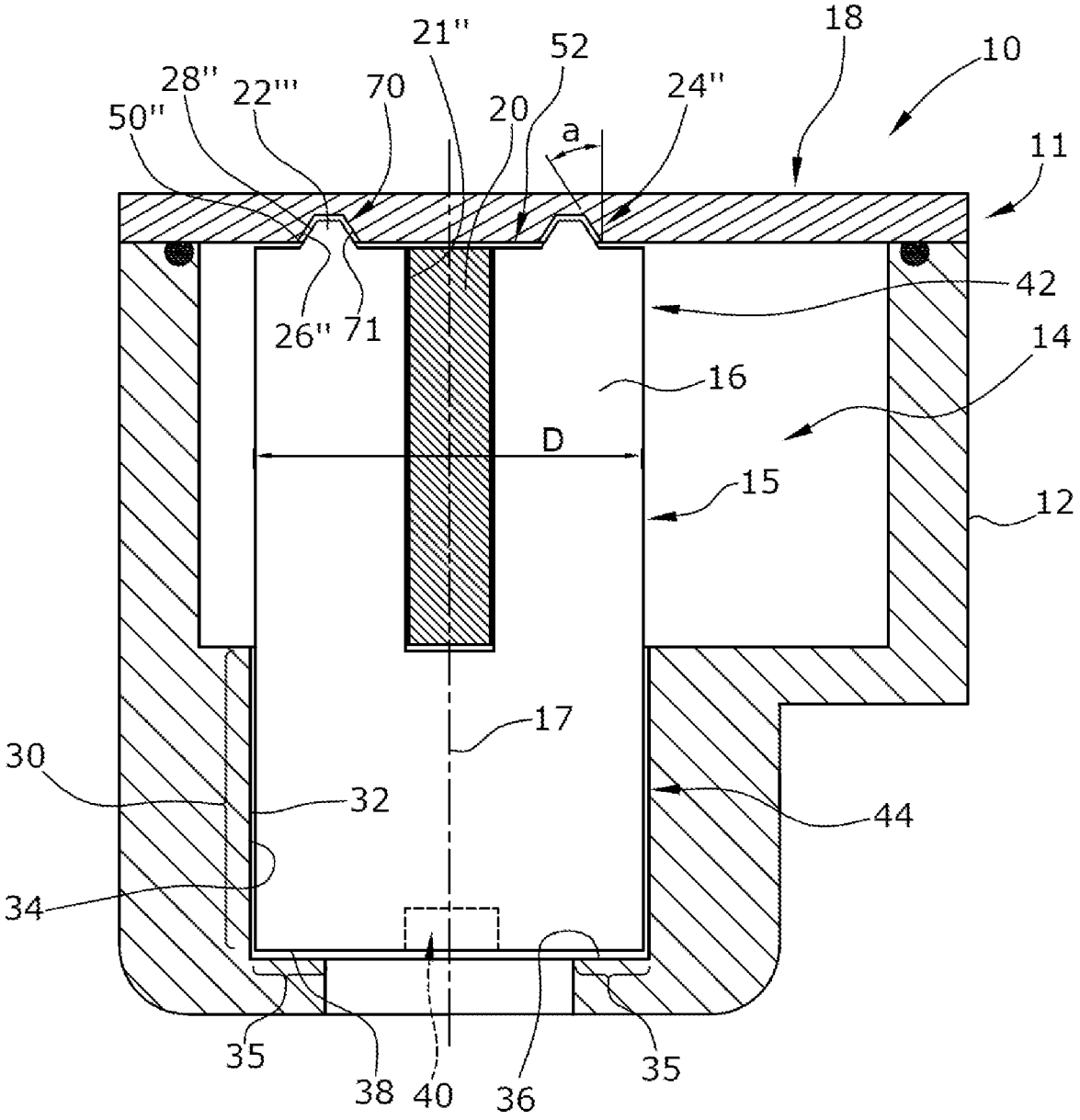
FIG. 4 shows a fourth embodiment of a mechanical automotive vacuum pump with an additional cone structure radially inside of the backing support cone structure.

The vacuum pump 10 according to the fourth embodiment shown in FIG. 4 is based on the third embodiment shown in FIG. 3, and is additionally provided with an additional cone structure being defined by an rotor-sided inner cone surface 70, which is supported by a corresponding outer cone surface 71 of the housing arrangement 11.

The present invention is not limited to embodiments described herein; reference should be had to the appended claims.

What is claimed is:

1. A mechanical automotive vacuum pump comprising:

a pump rotor comprising a rotor body and a rotational axis, the rotor body comprising a vane slit, a conical ring, a coupling-sided end portion, and a vane-sided end portion;

a housing arrangement comprising a static conical ring which corresponds to the conical ring of the rotor body, the housing arrangement being configured to enclose a pumping chamber and to rotatably support the pump rotor;

a slidable pump vane supported in the vane slit, the slidable pump vane being configured to separate the pumping chamber into a plurality of rotating pumping compartments; and a backing support cone structure arranged at a front end of the vane-sided end portion, the backing support cone structure being defined by the conical ring of the rotor body and the static conical ring of the housing arrangement, the backing support cone structure comprising a cone angle of between 5° and 85° with respect to the rotational axis of the pump rotor, wherein, a coupling structure which is configured to engage with a corresponding coupling structure of a pump drive and a single radial bearing are each arranged at the coupling-sided end portion of the rotor body and a radial bearing is not arranged at the vane-sided end portion of the rotor body so that the rotor body is radially supported cantilevered.

2. The mechanical automotive vacuum pump as recited in claim 1, wherein the cone angle is between 30° and 60°.

3. The mechanical automotive vacuum pump as recited in claim 1, wherein the rotor body is cylindrical and comprises one single diameter at the vane-sided end portion and at the coupling-sided end portion.

4. The mechanical automotive vacuum pump as recited in claim 3, wherein the backing support cone structure comprises a conus base comprising a same diameter as the one single diameter of the rotor body.

5. The mechanical automotive vacuum pump as recited in claim 3, wherein the backing support cone structure comprises a conus base comprising a diameter which is at least 10% smaller than the one single diameter of the rotor body.

6. The mechanical automotive vacuum pump as recited in claim 1, wherein a separate axial bearing is not arranged at the vane-sided end portion.

7. The mechanical automotive vacuum pump as recited in claim 1, wherein, the backing support cone structure is defined by one hollow cone which comprises a central recess, and the vane slit is axially open at the vane-sided end portion.

8. The mechanical automotive vacuum pump of as recited in claim 7, wherein, the housing arrangement further comprises an outer cone surface, the one hollow cone further comprises an inner cone surface which is supported by the outer cone surface of the housing arrangement, and the outer cone surface of the housing arrangement corresponds to the inner cone surface of the one hollow cone.

9. A mechanical automotive vacuum pump comprising:

a pump rotor comprising a rotor body and a rotational axis, the rotor body comprising a vane slit, a conical ring, a first end portion, and a vane-sided second end portion;

a housing arrangement comprising a static conical ring which corresponds to the conical ring of the rotor body, the housing arrangement being configured to enclose a pumping chamber and to rotatably support the pump rotor;

a slidable pump vane supported in the vane slit, the slidable pump vane being configured to separate the pumping chamber into a plurality of rotating pumping compartments; and a backing support cone structure arranged at a front end of the vane-sided second end portion, the backing support cone structure being defined by the conical ring of the rotor body and the static conical ring of the housing arrangement, the backing support cone structure comprising a cone angle of between 5° and 85° with respect to the rotational axis of the pump rotor, wherein, a single radial bearing is arranged at the first end portion of the rotor body and a radial bearing is not arranged at the vane-sided second end portion of the rotor body so that the rotor body is radially supported cantilevered.

10. The mechanical automotive vacuum pump as recited in claim 9, wherein the cone angle is between 30° and 60°.

11. The mechanical automotive vacuum pump as recited in claim 9, wherein the rotor body is cylindrical and comprises one single diameter at the vane-sided second end portion and at the first end portion.

12. The mechanical automotive vacuum pump as recited in claim 11, wherein the backing support cone structure comprises a conus base comprising a same diameter as the one single diameter of the rotor body.

13. The mechanical automotive vacuum pump as recited in claim 11, wherein the backing support cone structure comprises a conus base comprising a diameter which is at least 10% smaller than the one single diameter of the rotor body.

14. The mechanical automotive vacuum pump as recited in claim 9, wherein a separate axial bearing is not arranged at the vane-sided second end portion.

15. The mechanical automotive vacuum pump as recited in claim 9, wherein, the backing support cone structure is defined by one hollow cone which comprises a central recess, and the vane slit is axially open at the vane-sided second end portion.

16. The mechanical automotive vacuum pump of as recited in claim 15, wherein, the housing arrangement further comprises an outer cone surface, the one hollow cone further comprises an inner cone surface which is supported by the outer cone surface of the housing arrangement, and the outer cone surface of the housing arrangement corresponds to the inner cone surface of the one hollow cone.

* * * * *